US005177712A

United States Patent [19]

Kakizawa

[11] Patent Number: 5,177,712

[45] Date of Patent: Jan. 5, 1993

[54] CALENDAR DISPLAY DEVICE FOR A TIMEPIECE

[75] Inventor: Yukihisa Kakizawa, Suwa, Japan

[73] Assignee: Seiko Epson Corporation, Tokyo, Japan

[21] Appl. No.: 876,552

[22] Filed: Apr. 30, 1992

[30] Foreign Application Priority Data

Apr. 30, 1991 [JP] Japan ..... 3-98401

[51] Int. Cl.[5] ..... G04B 19/24

[52] U.S. Cl. ..... 368/28; 368/37

[58] Field of Search ..... 368/28, 31-40; 40/107, 111, 113-115

[56] References Cited

U.S. PATENT DOCUMENTS 3,842,590 10/1974 Kato ..... 368/35
4,232,510 11/1980 Tamaru et al. ..... 368/28
4,632,569 12/1986 Gegniat ..... 368/35
5,058,084 10/1991 Riesen ..... 368/10

*Primary Examiner*—Vit W. Miska

*Attorney, Agent, or Firm*—Blum Kaplan

[57] ABSTRACT

A calendar display device for a timepiece having a spindle which selectively rotates to drive the timepiece. The display device includes a day of the week wheel selectively rotatably coupled to the spindle, and a dial overlying the day of the week wheel having a window, with the dial including indicia around the periphery of the window representative of each day of the week. The day of the week wheel includes a plurality of day of the week indicators spaced therearound along the circumference of a circle passing essentially through the center of the window so that it is the day of the week wheel is selectively rotated, the indicators sequentially appear through the window and point selectively to the indicia to indicate the actual day of the week. The dial may also include an elongated circumferential window therein with days of the month positioned on opposing sides of the window. A second wheel includes indicators thereon for pointing out the particular day of the month through the window.

32 Claims, 6 Drawing Sheets

CALENDAR DISPLAY DEVICE FOR A TIMEPIECE

BACKGROUND OF THE INVENTION

This invention is generally directed to a calendar display device for an analog timepiece providing day and date information and, in particular, to a calendar display device which selectively points out the current day of the week among a display of all of the days of the week and/or the current day of the month among a display of all days of the month.

While analog watches have taken many forms, analog watches with calendar displays are known in the art. For example, FIG. 5 depicts the construction of a conventional mechanism for changing the display of days of a month (1 through 31) and days of a week (Sunday through Saturday) in a conventional analog timepiece. A conventional analog timepiece includes at least a first spindle 10 for driving at least an hour hand for producing time information. Other concentric spindles are generally provided to drive the minute and second hands. Conventional watches are also capable of providing day-of-the-week information and day-of-the-month information.

A day-changing wheel 12 is rotated by the driving force from spindle 10 and is rotated by a day-of-the-month wheel rotating pawl 14 provided on day-changing wheel 12. A day-of-the-week wheel rotating pawl 16 is provided on the day-changing wheel 12. A day-of-the-month wheel 13 is rotated in the direction of arrow A by the day-of-the-month wheel rotating pawl 14 and a day-of-the-week wheel 18 is rotated in the direction of arrow B by day-of-the-week wheel rotating pawl 16.

This conventional analog timepiece uses the driving force of spindle 10 to transmit rotational energy to day-changing wheel 12 to cause it to perform one complete revolution in every 24 hour period, thereby causing the day-of-the-month wheel rotating pawl 14 to rotate day-of-the-month wheel 13 by one thirty-first of one complete rotation, and day-of-the-week wheel rotating pawl 16 to rotate the day-of-the-week wheel 20 by one seventh of one complete rotation. Day-of-the-month wheel 13 includes numerals 15 (1 through 31) indicating the days of the month, and the day-of-the-week wheel 20 includes abbreviated words 21 representing the days of the week from Sunday to Saturday.

FIG. 6 depicts the dial of a conventional analog timepiece having day-of-the-month and day-of-the-week information. A time indicating dial overlies day-of-the-month wheel 13 and day-of-the-week wheel 20 and provides a window 22 through which one of the numerals 15 of day-of-the-month wheel 13 and one of the abbreviated words 21 of day-of-the-week wheel 20 are displayed.

FIGS. 7 and 8 exemplify conventional mechanisms for correcting the display of days of a month and days of a week, respectively. The display of the day of the month numeral 15 may be changed by pulling out crown 26 and rotating it in a first direction indicated by the arrow C, thereby causing the day-of-the-month wheel 13 to rotate via drum wheel 30 and correction wheel 31. Alternatively, the day-of-the-week wheel 20 may be changed by rotating crown 26 in a second direction indicated by the arrow D while the crown 26 is pulled out. The rotation of crown 26 causes drum wheel 30 to rotate in an alternate direction and causes correction wheel 31 to shift into contact with transmission wheel 35 to rotate the day-of-the-week wheel 20.

Such conventional analog timepiece devices as illustrated in FIGS. 5 and 6 suffer from the disadvantage that they are capable of displaying only one day of a month and one day of a week at a time, and are not equipped to display all of the days of the week or month like that of a monthly calendar.

The present invention is designed to overcome the problems inherent within the prior art as described above. Accordingly, it is desired to provide a device for displaying days of a month and of a week in a timepiece in such a way as to enable one to know what day of the month or week it is with respect to the remaining days of the month or week.

SUMMARY OF THE INVENTION

Generally speaking, in accordance with the present invention, a calendar display device for a timepiece is provided. The timepiece includes a spindle which selectively rotates to drive the timepiece. The calendar display device includes a day-of-the-week wheel selectively rotatably coupled to the spindle and a dial overlying the day-of-the-week wheel having a window therein. The dial includes indicia around the periphery of the window representative of each day of the week. The day-of-the-week wheel is provided with a plurality of day-of-the-week indicators spaced therearound along the circumference of a circle passing essentially through the center of the window so that as the day-of-the-week wheel is selectively rotated by the spindle of the timepiece, the indicators sequentially appear one at a time through the window and point selectively to the indicia to indicate the actual day of the week.

In this aspect of the invention, the dial displays all of the days of the week. The device includes a weekly operating mechanism including a day-of-the-week wheel which is rotated by a day-of-the-week wheel rotating pawl as described above. The day-of-the-week wheel rotating pawl is provided on a day changing wheel which is rotated by the driving force of the timepiece spindle. The dial also includes numerals along the outer periphery for indicating the actual time of day. The days of the week or abbreviations thereof are inscribed in a circular configuration around the window. The day-of-the-week wheel is provided with seven day-of-the-week indicators spaced thereon. Each of the indicators is equally spaced apart from one another along the circumference of the day-of-the-week wheel and each indicator passes through the center of the day-of-the-week window so that as the day-of-the-week wheel is rotated, the day-of-the-week indicators appear one at a time through the day-of-the-week window. Each day-of-the-week indicator sequentially passes through the day-of-the-week window and points to the abbreviated word representing the actual day of the week at that time.

The calendar display device of the present invention may also include a day-of-the-month wheel selectively rotatably coupled to the spindle. The dial would additionally include an elongated circumferential window therein defining a first upper edge and a second lower edge. A first set of numerals representative of some days of the month are positioned on the first edge of the window and a second set of numerals representative of the other days of the month are positioned on the second edge of the window. The day-of-the-month wheel includes a first indicator for selectively pointing to one of the numerals in the first set of numerals and a second indicator for pointing to one of the numerals in the second set of numerals after the first indicator has pointed to substantially all of the numerals in the first set.

In the second aspect of the invention, the dial alternatively or also displays the day of the month corresponding to the day of the week. The device includes a monthly operating mechanism comprising a day-of-the-month wheel which is rotated by a day-of-the-month wheel rotating pawl provided on the day changing wheel which is rotated by the driving force of the timepiece spindle as described above. A weekly operating mechanism comprising a day-of-the-week wheel which is rotated by the day-of-the-week wheel rotating pawl may also be provided on the day changing wheel.

The time indicating dial overlies the day-of-the-month and day-of-the-week wheels and is designed with one portion thereof having a first circumferentially extending inner row of day indicating numerals 1-16 and a second circumferentially extending outer row of day indicating numerals 17-31 and 1 which are concentric to the inner row of numerals. However, the configuration of the day of the month numerals may be varied to provide aesthetic pleasability. For example, the numerals may appear in a circular formation. The dial also includes a circular day-of-the-week window having abbreviated days of the week inscribed along the perimeter thereof.

The day-of-the-month wheel is provided with a first day-of-the-month indicator for pointing to the numerals in the inner row and a second day-of-the-month indicator is provided for pointing to the numerals in the outer row. Accordingly, as the day-of-the-month wheel is rotated, the first day-of-the-month indicator sequentially points to the inner row of numerals and upon the last day (16) of the inner row being pointed to, the second day-of-the-month indicator begins pointing to the numerals in the outer row. After the second day-of-the-month indicator has pointed to numeral 31, the first day-of-the-month indicator may again start to point to numeral 1 in the inner row and the second day-of-the-month indicator points to the number 1 in the outer row.

Synchronized with the day-of-the-month indicator sequentially changing from 1 to 31, the day-of-the-week is sequentially changed from Sunday (SUN) to Saturday (SAT) as described above.

With particular reference to the operation of the day-of-the-week function of this invention, the rotation of the day-of-the-week wheel causes the day-of-the-week indicator on the day-of-the-week wheel to be seen through the day-of-the-week window. Each day-of-the-week indicator sequentially passes through the day-of-the-week window and points to the respective abbreviated words that encircle the window, each word representing one of the days of the week.

With particular reference to the day-of-the-month function, the rotation of the day-of-the-month wheel causes the first day-of-the-month indicator on the day-of-the-month wheel to be seen through the day-of-the-month window and point to one of the numerals on the inner row (1 to 16) sequentially. After the first row of numerals is pointed to, the second day-of-the-month indicator can be seen through the day-of-the-month window, and the second indicator points to the outer row of numerals (17 to 31) sequentially.

Accordingly, it is an object of the present invention to provide an improved analog timepiece, wherein all the days of the month (1-31) or all the days of the week (Sunday-Saturday) are seen at all times upon the face of the dial and day-of-the-month and day-of-the-week indicators are provided to point to the particular day of the month or of the week at any particular moment.

Another object of the invention is to provide an analog timepiece that provides an aesthetically pleasing display while performing an important function such as a calendar would perform.

Still other objects and advantages of the invention will in part be obvious and will in part be apparent from the specification.

The invention accordingly comprises the features of construction combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
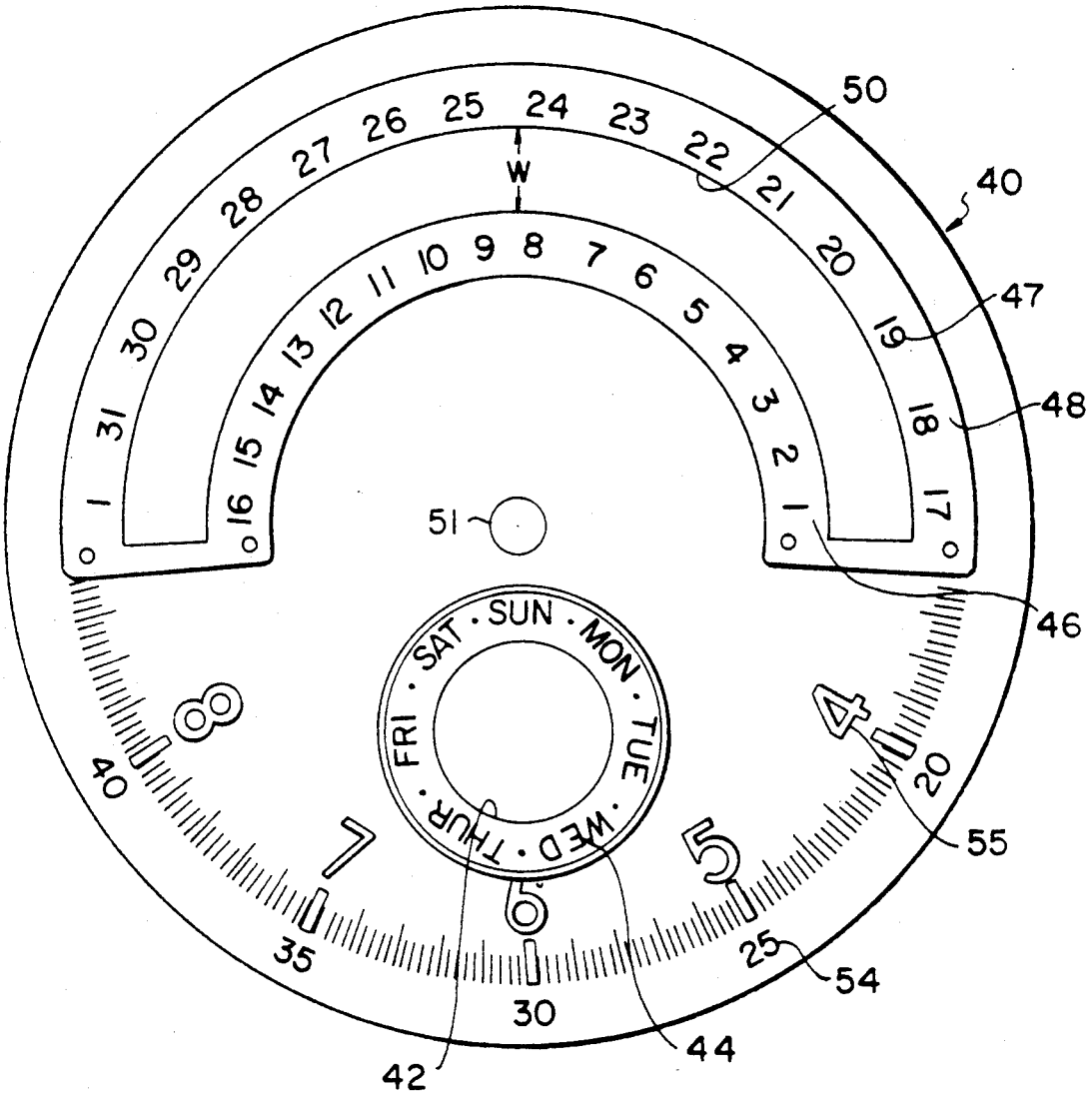
FIG. 1 is a top plan view of a dial in a timepiece showing day-of-the-week and day-of-the-month information constructed in accordance with a preferred embodiment of the present invention.

Particular reference is now made to FIG. 1 of the drawings, wherein a dial for a timepiece, generally indicated at 40, is depicted. Dial 40, also referred to as the watch face, is used to convert the mechanical movements of the timepiece into information usable to the wearer. Dial 40 is preferably formed with a circular day-of-the-week window 42 having its center in alignment with the line connecting the 6 and 12 o'clock positions of the timepiece, and situated toward the 6 o'clock position (below the center of the dial). Abbreviations 44 of the days of the week from Sunday to Saturday are positioned around the periphery of the day-of-the-week window 42.

The numerals showing days of the month are situated toward the 12 o'clock position of the watch face (above the center of the dial) and lie on the circumferences of two concentric circles, respectively. The inner row 46 of numerals includes numbers 1 to 16 and the outer row 48 of numerals includes numbers 17 to 31 and 1. In each row, the numerals increase sequentially in a counter-clockwise direction at equal intervals of space. In the preferred embodiment of FIG. 1, the numerals are 11.60° apart.

The day-of-the-month window 50 is defined by the space between the inner and outer rows 46 and 48 of numerals. Day-of-the-month window 50 is configured with a width w that is large enough to allow the day-of-the-month indicators to be seen therethrough as described below. The operation of the day-of-the-month indicators will be described hereinafter.

Dial 40 may also include a time indicating face including numerals 55 that indicate the hours of a day and numerals 54 that indicate the minutes past the hour. Numerals 55 and 54 are primarily located toward the 6 o'clock position (the bottom of dial 40) for the convenience of the user. Dial 40 also defines an opening 51 therethrough for receiving the spindles that drives the hands of the timepiece.

Although FIG. 1 depicts the preferred embodiment of the watch, multiple variations may be had. For example, to provide easier timekeeping ability, the inner and outer row of numbers 46 and 48, and the day of the month window may be made smaller or shifted downward to allow numbers 55 and 54 to be provided over the entire surface of dial 40. In an alternative embodiment, the shapes of the day of the week and day of the month windows 42 and 50 may be varied to provide an alternative aesthetic appearance.

Figure 2:
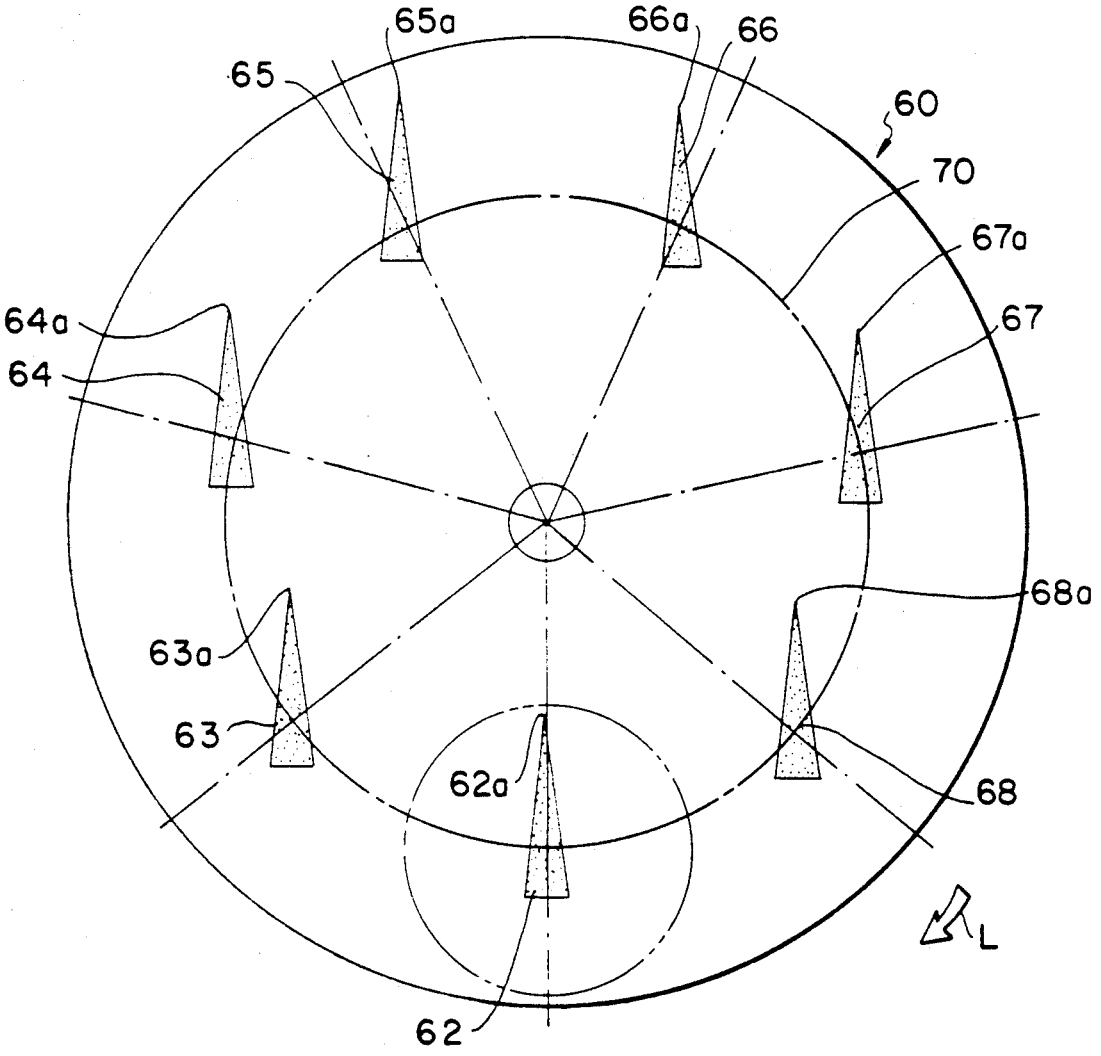
FIG. 2 is a top plan view of a day-of-the-week wheel used to point out the day-of-the-week on the dial of FIG. 1.

Particular reference is now made to FIG. 2, wherein a day-of-the-week wheel, generally indicated at 60, is depicted. Day-of-the-week wheel 60 is provided with day-of-the-week indicators 62 through 68 which are each shaped like an equilateral triangle. The indicators are at different angular positions with respect to the perimeter of the circle on which they lie and are spaced along the perimeter at equal intervals. Note also that the indicators all point in the same direction so that as they sequentially appear through window 42 in dial 40, they will point to each day of the week in sequence. In the embodiment shown, each indicator has a separation of 51.428°. Each day-of-the-week indicator 62–68 is located on the perimeter of a circle and passes through the center of day-of-the-week window 42 of FIG. 1 as it is rotated about its center point.

When day-of-the-week wheel 60 is positioned behind dial 40 of FIG. 1 in a timepiece, day-of-the-week wheel 60 will be rotated in the direction of arrow L. As day-of-the-week wheel 60 rotates, it causes indicators 62-68 to sequentially appear through window 42 to point to the actual or desired day of the week indicia SUN to SAT.

Figure 3:
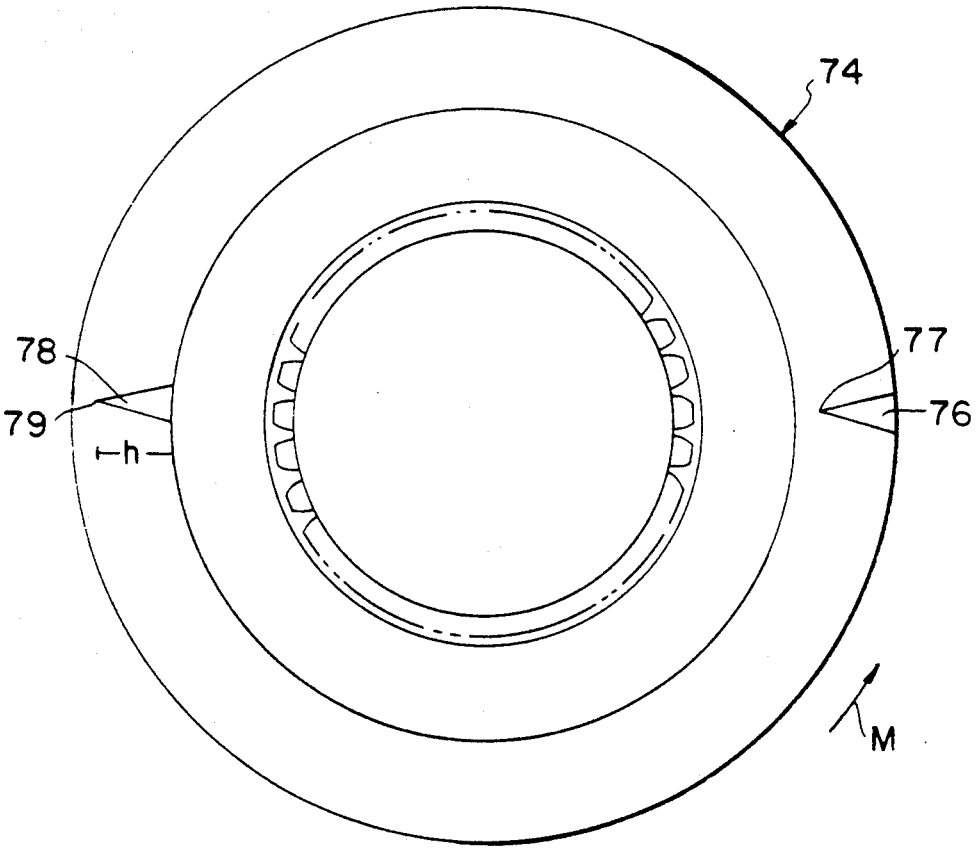
FIG. 3 is a top plan view of a day-of-the-month wheel used to point out the day-of-the-month on the dial of FIG. 1.

Particular reference is now also made to FIG. 3, wherein a day-of-the-month wheel, generally indicated at 74, is depicted. Day-of-the-month wheel 74 includes a first day-of-the-month indicator 76 printed thereon. First day-of-the-month indicator 76 includes a pointed end 77 positioned in a radially inwardly extending direction. Day-of-the-month wheel 74 also includes a second day-of-the-month indicator 78 which includes a pointed end 79 positioned in a radially outwardly extending direction. Day-of-the-month indicators 76 and 78 ar each shaped like equilateral triangles having a height h that makes them easily viewable through day-of-the-month window 50 of FIG. 1 having a width w. In a preferred embodiment, the height of indicators 76 and 78 are essentially equal to the width w of window 50. Day-of-the-month indicators 76 and 78 are both printed and aligned to be selectively visible through day-of-the-month window 50.

Indicators 76 and 78 are further positioned relative to each other such that when the first day-of-the-month indicator 76 points to numeral 1, the first numeral of the inner row 46 of the day-of-the-month display, the second day-of-the-month indicator 78 points to numeral 1, the last numeral of the outer row 48 of the day-of-the-month display. Note also that day-of-the-month wheel 74 is rotated in the direction of arrow M by the timepiece spindle.

Figure 4:
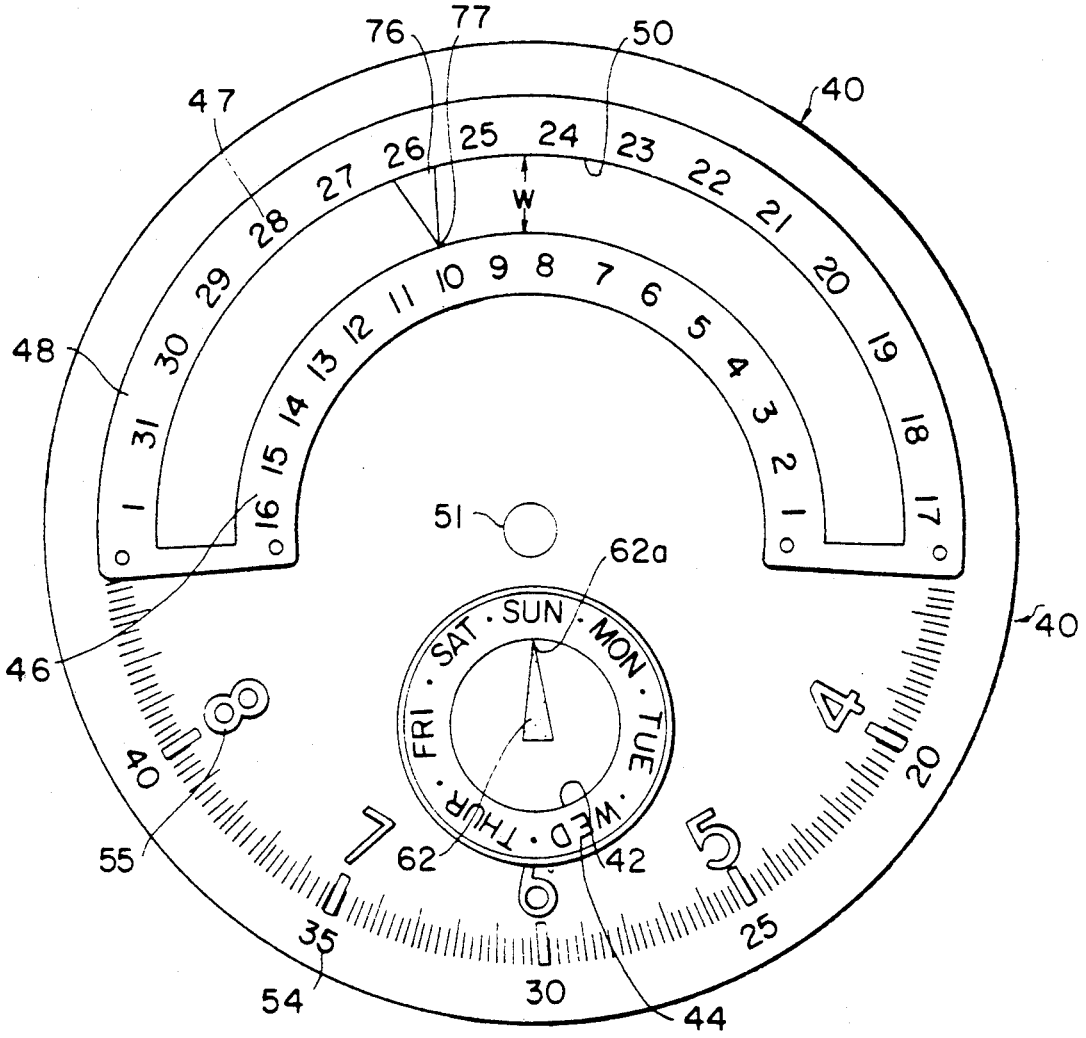
FIG. 4 is a top plan view of the dial of FIG. 1 showing the indicators of FIGS. 2 and 3 through the respective windows.
Figure 5:
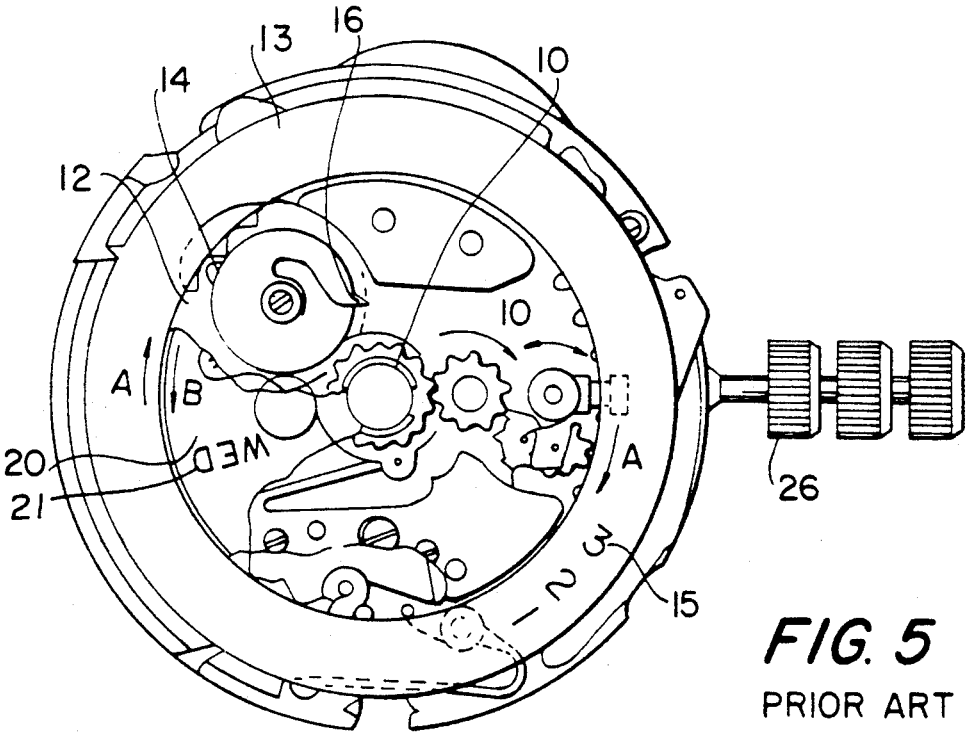
FIG. 5 PRIOR ART
FIG. 5 is a sectional top plan view of a conventional timepiece showing operation of the day and date wheels.
Figure 6:
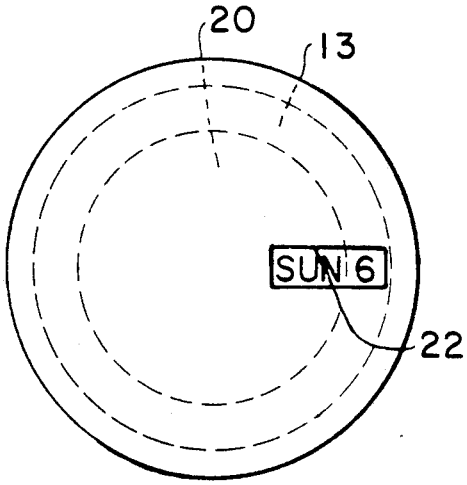
FIG. 6 PRIOR ART
FIG. 6 is a top plan diagrammatic view of the dial of a conventional analog timepiece shown displaying the day and date.

Particular reference is now made also to FIG. 4 which depicts the dial of FIG. 1 with the day-of-the-week and day-of-the-month wheels therebehind. It is seen that all of the days-of-the-week and month are depicted. The respective indicators point to the actual day of the week and month.

The day-of-the-week wheel 60 performs 1/7 of one complete revolution in every 24 hour time period. This results in each of the day-of-the-week indicators 62–68 reaching the center of the day-of-the-week window 42 once every seven days. Accordingly, the day-of-the-week indicators 62–68 have their respective pointed ends **62*a*–68*a* point to one of the abbreviated words (SUN-SAT) printed around window 42**, thereby indicating the seven days of the week, respectively.

The day-of-the-month wheel 74 performs 1/31 of one complete revolution in every 24 hour period and thereby causes the first day-of-the-month indicator 76 to sequentially point to numerals 1–16 of the inner row 46. The second day-of-the-month indicator 78 then sequentially points to numerals 17–31 and 1 in the outer row of numerals 48. Further, first and second day-of-the-month indicators 76 and 78 are not visible together through day-of-the-month window 50, except when they both point to the numeral 1.

Figure 7:
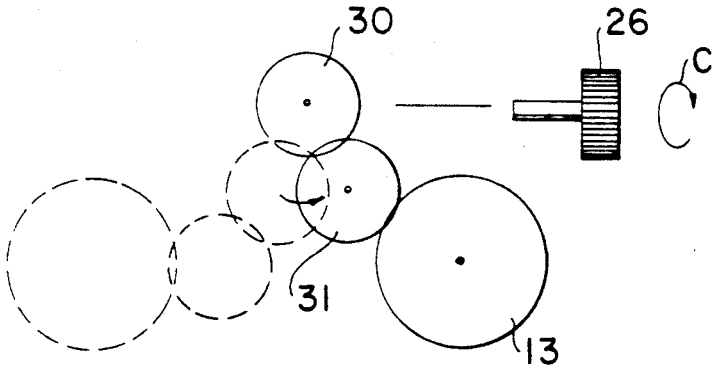
FIG. 7 PRIOR ART
FIG. 7 is a fragmentary schematic view showing the mechanism for quick correction of day-of-the-month information and depicting the mechanism for correction of day-of-the-week information in phantom.
Figure 8:
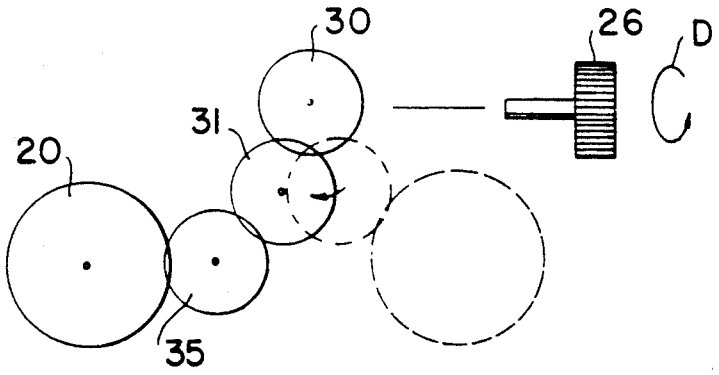
FIG. 8 PRIOR ART
FIG. 8 is a fragmentary schematic view of the mechanisms for correcting day-of-the-week information and depicting the mechanisms for correcting day-of-the-month information in phantom.

The conventional mechanisms may be used for driving the day-of-the-month and day-of-the-week wheels 74 and 60 embodying this invention. Further, the conventional quick correction mechanisms, for example as shown in FIGS. 7 and 8 as described above, may be used for correcting the display of days of the month and of the week in the present invention.

Among the many advantages provided by this invention, is that this invention facilitates an analog display to show all the days of the week permanently upon the dial face and utilizes conventional mechanism for changing the display. Further, this is accomplished with only simple changes in construction including the provision of the day-of-the-week indicators on the day-of-the-week wheel and a modification of the dial. Accordingly, it is possible to know what day of the week it is in the context of the entire week.

The second feature of this invention enables a analog display to show all of the days of the month and the corresponding day of the week by utilizing the conventional mechanism for changing the display with only minor modifications. Accordingly, it is possible to know what day it is in a month, or week, like would be seen in a monthly calendar. Numerals 47 indicating the days of the month are provided on one portion of the dial (the top of the dial in the preferred embodiment), and the remaining portion of the dial provides the time indicating face, including hour indicating numerals 55 and minute indicating numerals 54, for the convenience of the user.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A calendar display device for a timepiece, said timepiece having a spindle which selectively rotates to drive the timepiece, comprising a day of the week wheel selectively rotatably coupled to said spindle, a dial overlying said day of the week wheel having a first window therein, said dial including indicia around the periphery of said first window representative of each day of the week, said day of the week wheel including a plurality of day of the week indicators space therearound along the circumference of a circle passing essentially through the center of said first window so that as said day of the week wheel is selectively rotated, said indicators sequentially appear through said first window and point selectively to said indicia to indicate the actual day of the week.

2. The calendar display device as claimed in claim 1, wherein said first window is circular.

3. The calendar display device as claimed in claim 2, wherein said first window is positioned below the center of said dial.

4. The calendar display device a claimed in claim 1, wherein said indicators are equally spaced apart on said day of the week wheel and point in the same direction.

5. The calendar display device as claimed in claim 4, wherein there are seven equally spaced indicators on said day of the week wheel.

6. The calendar display device as claimed in claim 2, wherein said indicators are triangular in shape and point in the same direction.

7. The calendar display device as claimed in claim 6, wherein there are seven of said indicators each spaced apart from one another around the circumference of a circle by about 51°.

8. The calendar display device as claimed in claim 1, wherein said day of the week wheel includes center, said center being coupled to said spindle.

9. The calendar display device as claimed in claim 1, further comprising a day of the month wheel selectively rotatably coupled to said spindle, said dial overlying said day of the month wheel, said dial having an elongated circumferential second window therein defining a first edge and a second edge, a first set of numerals representative of some days of the month on the first edge of said second window and a second set of numerals representative of the other days of the month on the second edge of said second window, said day of the month wheel having a first date indicator thereon for selectively pointing sequentially to each of said numerals in said first set of numerals and a second date indicator thereon for selectively pointing sequentially to each of said numerals in said second set of numerals after said first indicator has pointed to substantially all of the numerals in said first set of numerals.

10. The calendar display device as claimed in claim 9, wherein said first set of numerals lie in a first row and said second set of numerals lie in a second row, said first and second rows of numerals being concentric.

11. The calendar display device as claimed in claim 10, wherein said first row of numerals is spaced radially inward from said second row of numerals.

12. The calendar display device as claimed in claim 10, wherein said first row of numerals includes the numerals 1 through 16 and the second row of numerals includes the numerals 17 through 31.

13. The calendar display device as claimed in claim 9, wherein said first and second date indicators are triangular in shape.

14. The calendar display device as claimed in claim 13, wherein said first date indicator points radially inward and said second date indicator points radially outward.

15. The calendar display device as claimed in claim 9, wherein said second window has a predetermined width, said first and second date indicators having a height essentially corresponding to said width.

16. The calendar display device as claimed in claim 11, wherein said first row of numerals includes the numerals 1 through 16 and the second row of numerals includes the numerals 17 through 31.

17. The calendar display device as claimed in claim 16, wherein said second row of numerals includes the numeral 1 after the numeral 31.

18. The calendar display device as claimed in claim 17, wherein said first date indicator points to the numeral 1 in said first row of numerals and said second date indicator points to the numeral 1 in said second row of numerals at the same time.

19. The calendar display device as claimed in claim 12, wherein said first and second date indicators are equilateral triangles.

20. A calendar display device for a timepiece, said timepiece having a spindle which selectively rotates to drive the timepiece, comprising a day of the month wheel selectively rotatably coupled to said spindle, a dial overlying said day of the month wheel having an elongated circumferential window therein defining a first edge and a second edge, a first set of numerals representative of some days of the month on the first edge of said window and a second set of numerals representative of the other days of the month on the second edge of said window, said day of the month wheel having a first indicator thereon for selectively pointing to one of said numerals in said first set of numerals and a second indicator thereon for selectively pointing sequentially to each of said numerals in said second set of numerals after said first indicator has pointed to substantially all of the numerals in said first set of numerals.

21. The calendar display device as claimed in claim 20, wherein said first set of numerals lie in a first row and said second set of numerals lie in a second row, said first and second rows of numerals being concentric.

22. The calendar display device as claimed in claim 21, wherein said first row of numerals is spaced radially inward from said second row of numerals.

23. The calendar display device as claimed in claim 21, wherein said first row of numerals includes the numerals 1 through 16 and the second row of numerals includes the numerals 17 through 31.

24. The calendar display device as claimed in claim 20, wherein said first and second indicators are triangular in shape.

25. The calendar display device as claimed in claim 24, wherein said first indicator points radially inward and said second indicator points radially outward.

26. The calendar display device as claimed in claim 20, wherein said second window has a predetermined width, said first and second indicators having a height essentially corresponding to said width.

27. The calendar display device as claimed in claim 22, wherein said first row of numerals includes the numerals 1 through 16 and the second row of numerals includes the numerals 17 through 31.

28. The calendar display device as claimed in claim 27, wherein said second row of numerals includes the numeral 1 after the numeral 31.

29. The calendar display device as claimed in claim 28, wherein said first indicator points to the numeral 1 in said first row of numerals and said second indicator points to the numeral 1 in said second row of numerals at the same time.

30. The calendar display device as claimed in claim 24, wherein said first and second indicators are equilateral triangles.

31. The calendar display device as claimed in claim 29, wherein said numerals in said first and second sets are spaced about 11.6° apart.

32. The calendar display device as claimed in claim 20, wherein said window is positioned above the center of said dial.

* * * * *